US006793161B1

(12) United States Patent
Fujita et al.

(10) Patent No.: US 6,793,161 B1
(45) Date of Patent: Sep. 21, 2004

(54) NEEDLE LIFT DAMPER DEVICE OF INJECTOR FOR FUEL INJECTION AND NEEDLE LIFT DAMPING METHOD

(75) Inventors: Mahoro Fujita, Perinton, NY (US); Hermann Breitbach, Crauthem (LU); Terukazu Nishimura, Fujisawa (JP); Akihiko Minato, Fujisawa (JP); Shigehisa Takase, Fujisawa (JP)

(73) Assignees: Isuzu Motors Limited, Tokyo (JP); Delphi Technologies, Inc., Troy, MI (US)

( * ) Notice: Subject to any disclaimer, the term of this patent is extended or adjusted under 35 U.S.C. 154(b) by 108 days.

(21) Appl. No.: 10/203,434

(22) PCT Filed: Nov. 17, 2000

(86) PCT No.: PCT/JP00/08137

§ 371 (c)(1),
(2), (4) Date: Aug. 5, 2002

(87) PCT Pub. No.: WO02/40854

PCT Pub. Date: May 23, 2002

(51) Int. Cl.[7] ..... F02M 51/00

(52) U.S. Cl. ..... 239/585.1; 239/533.2; 239/585.5

(58) Field of Search ..... 239/533.2, 533.3, 239/533.9, 533.11, 585.1–585.5

(56) References Cited

U.S. PATENT DOCUMENTS 4,627,571 A * 12/1986 Kato et al. ..... 239/92
4,911,366 A * 3/1990 Priesner ..... 239/533.3
5,551,391 A * 9/1996 Beck et al. ..... 123/305
6,142,443 A * 11/2000 Potschin et al. ..... 251/57

FOREIGN PATENT DOCUMENTS

| | | |
|---|---|---|
| JP | 02-146255 | 6/1990 |
| JP | 05-079422 | 3/1993 |
| JP | 06-066218 | 3/1994 |
| JP | 07-011996 | 1/1995 |
| JP | 2000-329024 | 11/2000 |

OTHER PUBLICATIONS

Copy of PCT Publication No. WO 02/ 40854 A1 with International Search Report attached for PCT Ser. No. PCT/ JP00/ 08137.

* cited by examiner

*Primary Examiner*—Michael Mar
*Assistant Examiner*—Thach H. Bui
(74) *Attorney, Agent, or Firm*—McCormick, Paulding & Huber LLP

(57) ABSTRACT

An object of the present invention is to obtain a consistently stable needle lift damping effect in an injector 8*b* for fuel injection. In an injector 8*b* that relieves fuel pressure inside a pressure control chamber 37 and lifts a needle valve 36, there are provided a damper member 62 that is slidably mounted to the needle valve 36, a damping chamber 63 formed between the damper member 62 and the needle valve 36, a leak passage 64 for extracting and leaking out the fuel in the damping chamber 63, and a stopper member 41 to restrict the lift position of the damper member 62. Damping of the lift of the needle valve 36 is carried out by extracting and leaking out the fuel in the damping chamber 63 through the leak passage 64. The needle valve 36 functions as a guide for the damper member 62, and prevents vibration of the damper member 62, allowing a consistently stable damping effect to be obtained.

18 Claims, 6 Drawing Sheets

NEEDLE LIFT DAMPER DEVICE OF INJECTOR FOR FUEL INJECTION AND NEEDLE LIFT DAMPING METHOD

REFERENCE TO PRIOR APPLICATION

This application is entitled to the benefit of and incorporates by reference essential subject matter disclosed in PCT Patent Application No. PCT/JP00/08137 filed on 17 Nov. 2000.

TECHNICAL FIELD

The present invention relates to a needle lift damper device in an injector for fuel injection, and a needle lift damping method. In particular, it relates to a device and method for damping needle valve lift in order to decrease the initial injection rate of a common rail injector in a diesel engine.

BACKGROUND ART

FIG. 4 shows an outline of a common rail-type fuel injection device in a diesel engine. As shown in the drawing, in this device, fuel within a fuel tank 1 is supplied to a high-pressure pump 4 through a filter 2 and a feed pump 3. After being pressurized to a high pressure (tens to hundreds of MPa) by the high-pressure pump 4, the fuel goes through a passage 5 and is stored in an accumulator called a common rail 6. The fuel inside the common rail 6 is supplied to each injector 8 through a fuel supply passage 7.

As shown in FIG. 5, a portion of the high-pressure fuel that is supplied to each injector 8 is supplied to a pressure control chamber 10 through a passage 9 and the remaining portion is supplied through a passage 11 to a fuel puddle 13 at the tip of a needle valve 12. The fuel pressure inside the pressure control chamber 10 is maintained and released by a relief valve 14. The relief valve 14 is depressed by a conventional spring 15 and closes a relief hole 16, maintaining the fuel pressure in the pressure control chamber 10. When an electromagnetic solenoid 17 is driven by an electric current, the relief valve 14 resists the spring 15 and is lifted up, thereby opening the relief hole 16 and releasing the fuel pressure in the pressure control chamber 10. Further, the needle valve 12 is constantly forced downwards by a spring 18.

In such injectors 8, when the electric current to the electromagnetic solenoid 17 is turned off, the relief hole 16 is closed by the relief valve 14 that is pressed down by the spring 15; and since the fuel pressure in the pressure control chamber 10 is maintained, the downward force on the needle valve 12 created by such fuel pressure and the spring 18 becomes greater than the upward force thereon created by the fuel pressure in the pressure-receiving portion 19 at the tip (fuel puddle 13) of the needle valve 12; and accordingly the needle valve 12 moves downward. Consequently, a conical portion 20 at the tip of the needle valve 12 is mounted to a seat 21, closing a spray hole 22 of the injector 8 so that fuel injection does not occur. thereon created by the fuel pressure in the pressure-receiving portion 19 at the tip (fuel puddle 13) of the needle valve 12; and accordingly the needle valve 12 moves downward. Consequently, a conical portion 20 at the tip of the needle valve 12 is mounted to a seat 21, closing a spray hole 22 of the injector 8 so that fuel injection does not occur.

Further, when the electromagnetic solenoid 17 is driven by an electric current, the relief valve 14 resists the spring 15 and is lifted up; and since the relief hole 16 is opened and the fuel pressure in the pressure control chamber 10 is released, the upward force on the needle valve 12 created by the fuel pressure in the pressure receiving portion 19 at the tip (fuel puddle 13) of the needle valve 12 becomes greater than the downward force thereon created by the fuel pressure and the spring 18; and accordingly the needle valve 12 lifts upward. Consequently, the conical portion 20 at the tip of the needle valve 12 becomes detached from the seat 21 and high pressure fuel is injected from the spray hole 22 of the injector 8. Note that the fuel flowing out of the pressure control chamber 10 is returned to the fuel tank 1 through a fuel return passage 23 (See FIG. 4).

In the above-mentioned injector 8, it is desirable that the needle valve 12 is made to lift upward comparatively smoothly (slowly). If the needle valve 12 is made to lift upwards comparatively smoothly, the initial injection rate of the fuel injected from the spray hole 22 decreases, and since the first ignition after an ignition delay occurs with a low injection rate and a small amount of fuel, a smooth first ignition can be guaranteed, resulting in less NOx emitted and a decrease in noise.

FIG. 6 shows an injector that is known to lift the needle valve 12 comparatively slowly (for example, Japanese Patent Application Laid-open No. S59-165858). Note that since this injector 8*a* has some constituent parts that are the same as the previously mentioned injector 8, identical reference numerals are used for the same constituent parts, and explanations are omitted. Only the different parts are explained.

In the injector 8*a* shown in FIG. 6, a member 24 is attached to the upper end of the needle valve 12, and the pressure control chamber 10 is formed above the member 24. The relief hole 16 is formed on the ceiling of the pressure control chamber 10. A seat 25 that is in a raised position is formed around the relief hole 16. The relief hole 16 is opened and closed by the relief valve 14, having an orifice hole 26 in its center, when it mounts to and disengages from the seat 25.

The relief valve 14 is pressed onto the seat 25 by a conventional spring 27, thereby closing the relief hole 16; and when fuel is supplied from a three-way valve 28, due to the fuel pressure, the relief valve 14 resists the spring 27 and is pushed downward, opening the relief hole 16. The three-way valve 28 is positioned in the passage 9 leading from the common rail 6 (see FIG. 4) to the pressure control chamber 10 and is switched over as appropriate between a state where X-Y are linked to each other and a state where Y-Z are linked to each other.

FIG. 6 shows the state when fuel injection has ceased. At this time, X-Y are linked to each other, the relief valve 14 is mounted to the seat 25, and the downward force on the needle valve 12 created by the fuel pressure inside the pressure control chamber 10 and the spring 18 is greater than the upward force thereon created by the fuel pressure in the fuel receiving portion 19 at the tip (fuel puddle 13) of the needle valve 12. Consequently, the needle valve 12 moves downward and the conical portion 20 is mounted to the seat 21, closing the spray hole 22 so that fuel injection does not occur. From this state, when the three-way valve 28 operates so that Y-Z are linked to each other, since the fuel in the pressure control chamber 10 is gradually squeezed from the orifice hole 26 in the relief valve 14 and flows out, the fuel pressure in the pressure control chamber 10 decreases at a smooth pace and the needle valve 12 lifts upward comparatively slowly. In this way lift damping of the needle valve is achieved and the initial injection rate from the spray hole 22 is decreased.

Subsequently, when the three-way valve 28 operates so that X-Y are linked to each other for a second time, since the fuel in the common rail 6 flows through passages 7 and 9 in a high-pressure state into the pressure control chamber 10, the relief valve 14 resists the spring 27 and is depressed due to the fuel pressure. The fuel flows into the pressure control chamber 10 in one burst and the fuel pressure in the pressure control chamber 10 rises at once, so the needle valve 12 moves downward rapidly. Consequently, the injection cut-off of the fuel injected from the spray hole 22 is improved.

However, in the above-mentioned injector 8*a,* since damping the lift of the needle valve 12 is achieved by mounting the relief valve 14 to the seat 25 as well as making the fuel in the pressure control chamber 10 leak out while being squeezed from the orifice hole 26, disturbance in the leak flow that occurs at the time of leakage from the orifice hole 26 can cause the relief valve 14 to vibrate and momentarily become dislodged from the seat 25.

When this occurs, since the fuel in the pressure control chamber 10 leaks not only from the orifice hole 26 but also from the gap between the relief valve 14 and the seat 25, the damping effect in respect of the lift of the needle valve 12 becomes lower than the design value and a sufficient damping effect is not obtained. Further, such a problem is intermittent on each occasion of leakage from the orifice hole 26 (or injection from the spray hole 22), thus making it difficult in fact to obtain a stable damping effect (initial injection rate reduction effect).

More specifically, in the above-mentioned injector 8*a,* the pressure control chamber 10 that controls the upward and downward movement (opening and closing) of the needle valve 12 also functions as a damping chamber for damping the needle valve 12. Therefore, in order to perform damping when the needle valve 12 is lifting upward, while it is necessary that the relief valve 14 is mounted to the seat 25 and is sealed, it is also necessary that the sealed portion (relief valve 14 and seat 25) is disengaged when the needle valve 14 is moving downward.

In this way, since the sealed portion (relief valve 14 and seat 25) is mounted together and disengaged during the upward and downward movement of the needle valve 12, when the needle valve 12 is lifting upward, as described above, the relief valve 14 vibrates and may momentarily become dislodged from the seat 25 due to the pressure variation of the pressure control chamber 10 that functions as a damping chamber, thereby making the seal defective.

It is an object of the present invention, which was designed with the foregoing circumstance in mind, to provide a needle lift damper device in an injector for fuel injection and a needle lift damping method that enables a stable damping effect to be consistently obtained.

A further object of the present invention is to provide a needle lift damper device in an injector for fuel injection and a needle lift damping method that enables a stable fuel leak to be consistently produced.

A further object of the present invention is to provide a needle lift damper device in an injector for fuel injection and a needle lift damping method that enables the initial injection rate of each injection to be stabilized.

DISCLOSURE OF INVENTION

The present invention is a damper device designed to achieve damping of the lift of a needle valve in an injector that lifts the needle valve that is depressed after receiving fuel pressure inside the pressure control chamber, by relieving the fuel pressure. It comprises a damper member slidably mounted to the needle valve; a damping chamber that becomes filled with fuel, formed between the damper member and the needle valve; a leak passage for extracting fuel from inside the damping chamber and leaking it outside the chamber; and a stopper member located above the damper member for restricting the lift position of the damper member.

According to the present invention, since the damper member is slidably mounted to the needle valve, the needle valve guides the damper member in an upward and downward movement and prevents vibration of the damper member. In such a way, a stable damping effect can be consistently produced.

It is desirable that the damper member is slidably inserted in an axial direction into a hole formed in the needle valve.

The stopper member is positioned above the needle valve and the pressure control chamber is defined therebetween, while the hole is formed to a prescribed depth axially from the upper surface of the needle valve, and the damper member is inserted into this hole from above and is able to move up and down in the pressure control chamber. The damping chamber is formed between the damper member and the hole, and it is desirable to form the leak passage passing through the damper member in an axial direction.

The upper end of the damper member is a flange that is larger in diameter than the hole and smaller in diameter than the upper surface of the needle valve and it is desirable that this flange is positioned above the hole and upper surface of the needle valve as well as being positioned inside the pressure control chamber.

It is desirable that a biasing means to impel the damper member upwards is formed in the damping chamber.

The biasing means consists of a coil spring, and it is desirable that a spring insertion hole having a prescribed depth is formed in the damper member facing upward from the bottom thereof, and that the coil spring is inserted into this spring insertion hole.

It is desirable that a relief passage, opening into the pressure control chamber to relieve the fuel pressure therein, is formed in the stopper member.

It is desirable that when the damper member abuts against the stopper member, the relief passage is prevented from communicating with the pressure control chamber and communicates with the damping chamber through the leak passage.

It is desirable that the fuel pressure is introduced into the pressure control chamber through the relief passage.

It is desirable that above the stopper member, a relief valve to open and close the exit of the relief passage and an driving means to drive the opening and closing of the relief valve are formed.

The driving means may consist of a spring and electromagnetic solenoid.

When the relief valve is closed and a prescribed period of time has elapsed, the pressure control chamber and the damping chamber reach a high pressure equal to the fuel pressure and the needle valve is depressed. Fuel injection is halted and the damper member abuts againststopper member. It is desirable that from this state, when the relief valve opens, the high-pressure fuel in the damping chamber flows through the leak passage and is gradually leaked into the relief passage, enabling the needle valve to lift up comparatively smoothly so that the initial injection is conducted comparatively smoothly. It is desirable that from this state, when the relief valve is closed, the fuel pressure supplied to the relief passage acts on the damper member such that the damper member and the needle valve are depressed together, making the needle valve move downward comparatively rapidly and halting the fuel injection comparatively rapidly.

When applied to a common rail-type fuel injection device in a diesel engine, the fuel pressure can be supplied from the common rail.

The present invention is also a method for damping the lift of the needle valve in an injector that lifts the needle valve that is depressed after receiving fuel pressure in the pressure control chamber, by relieving the fuel pressure. A damper member is slidably mounted to the needle valve; a damping chamber that becomes filled with fuel is formed therebetween; a leak passage for extracting fuel from inside the damping chamber and leaking it outside the chamber is formed; and a stopper member positioned above the damper member for restricting the lift position thereof is formed. When the needle valve lifts, the fuel in the damping chamber is extracted and leaked through the leak passage, thereby damping the lift of the needle valve.

It is desirable that the damper member is slidably inserted in an axial direction into a hole formed in the needle valve.

The stopper member is positioned above the needle valve and the pressure control chamber is defined therebetween, while the hole is formed to a prescribed depth from the upper surface of the needle valve in an axial direction, and the damper member is inserted into this hole from above and is able to move up and down in the pressure control chamber.

The damping chamber is formed between the damper member and the hole, and it is desirable to form the leak passage so as to pass through the damper member in an axial direction. It is desirable that the damper member is impelled upward by a biasing means formed in the damping chamber.

It is desirable that a relief passage, opening into the pressure control chamber is formed axially so as to pass through the stopper member, and the fuel pressure in the pressure control chamber is relieved by this relief passage.

The relief passage and leak passage are positioned on the same axis and when the damper member abuts against the stopper member, the relief passage is prevented from communicating with the pressure control chamber, but instead communicates with the damping chamber through the leak passage; and it is desirable that before the needle valve begins to lift, the damper member is made abut against the stopper member.

When the relief valve is closed and a prescribed period of time has elapsed, the pressure control chamber and the damping chamber reach a high pressure equal to the fuel pressure, and the needle valve is depressed. Fuel injection is halted and the damper member abuts against the stopper member.

It is desirable that from this state, when the relief valve opens, the high-pressure fuel in the damping chamber flows through the leak passage and is gradually leaked into the relief passage, enabling the needle valve to lift up comparatively smoothly, with the result that the initial injection is carried out comparatively smoothly.

It is desirable that from this state, when the relief valve is closed, the fuel pressure supplied to the relief passage acts on the damper member so that the damper member and the needle valve are depressed together, making the needle valve move downward comparatively rapidly with the result that fuel injection is halted comparatively rapidly.

When applied to a common rail-type fuel injection device in a diesel engine, the fuel pressure can be supplied from the common rail.

BEST MODE FOR CARRYING OUT THE INVENTION

Preferred embodiments of the present invention will be described below, based on the attached drawings.

Figure 1:
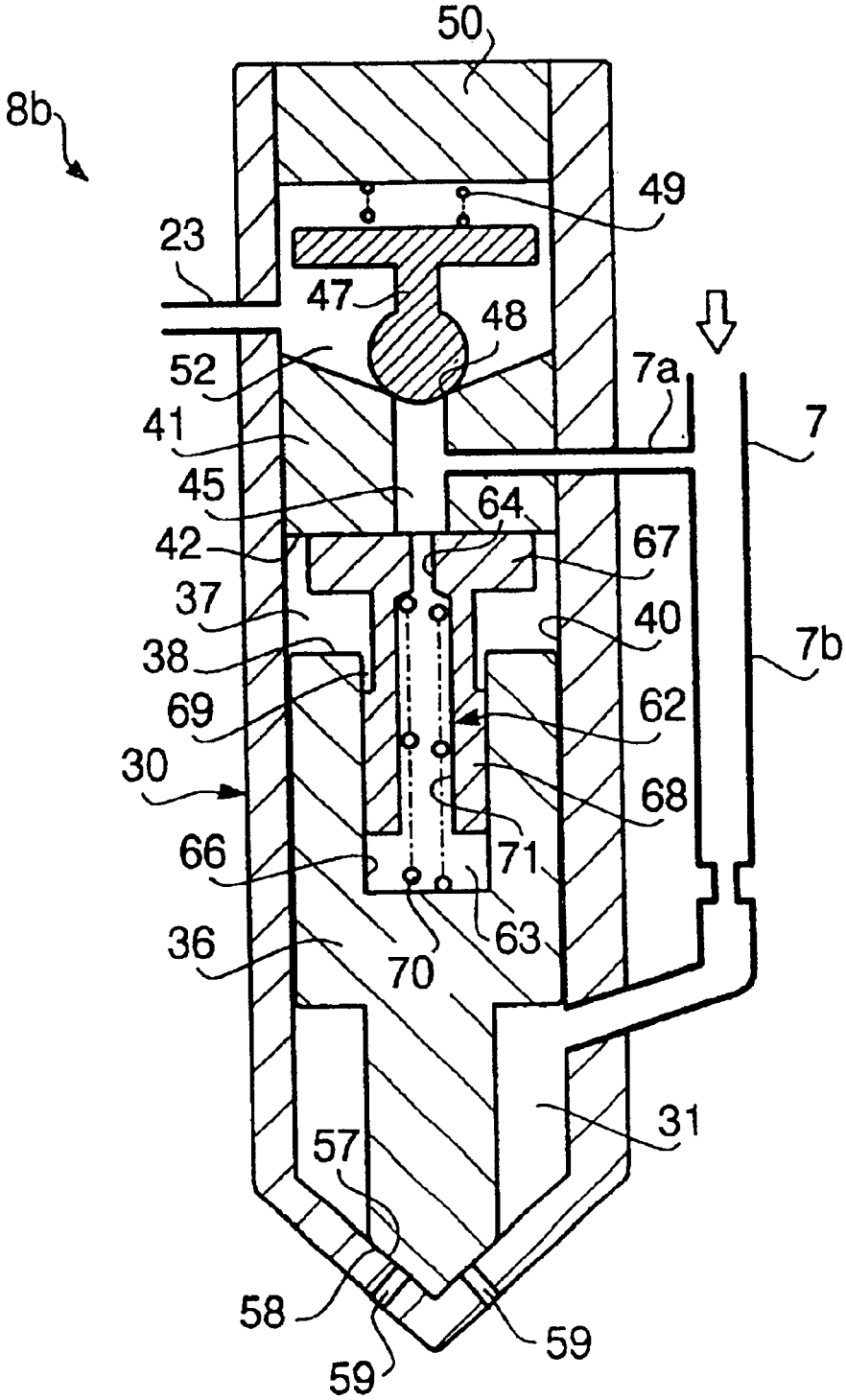
FIG. 1 is a longitudinal sectional view showing an injector according to a preferred embodiment of the present invention and showing the fuel injection standby mode.

FIG. 1 shows an injector according to the present embodiment. The injector 8*b* is applied in the aforementioned common rail-type fuel injection device shown in FIG. 4, and has a nozzle body 30 wherein a fuel supply passage 7 and a fuel return passage 23 are connected. The nozzle body 30 is formed in a cylindrical state and a needle valve 36 is slidably contained axially therein, able to move up and down on the same axis. Further, inside the nozzle body 30, a stopper member 41 is inserted and fixed above the needle valve 36, separated therefrom at a prescribed distance.

Between the needle valve 36 and the stopper member 41, a pressure control chamber 37 is defined and formed. The pressure control chamber 37 is defined by an upper surface 38 of the needle valve 36, an inside surface 40 of the nozzle body 30, a lower surface 42 of the stopper member 41 and a damper member 62 that will be described later. In the central portion of the stopper member 41, a relief passage 45 to relieve the fuel pressure (fuel) in the pressure control chamber 37 upward, is formed to pass through the stopper member 41 in an axial direction. The upper surface of the stopper member 41 is depressed in a tapered state so that its center is as low as possible, and the exit of the relief passage 45 opens into the center of the upper surface. The rim of this opening is the seat 48 of the relief valve 47 that opens and closes the relief passage 45. The lower surface 42 of the stopper member 41 is a flat surface perpendicular to the axial direction and the entry of the relief passage 45 opens into it.

The relief valve 47 is positioned above the stopper member 41 and opens and closes the exit of the relief passage from above. Further, a spring 49 and an electromagnetic solenoid 50 are located above the relief valve 47. The spring 49 forces the relief valve 47 downward and the electromagnetic solenoid 50 is provided with an electric current from an external control unit to drive it and is turned ON and OFF. Note that the electromagnetic solenoid 50 also acts as the stopper that blocks the top release portion of the nozzle body 30. When the electromagnetic solenoid 50 is turned to OFF (not conducting), the relief valve 47 is depressed by the spring 49 and is mounted to the seat 48 so that the relief passage 45 closes. When the electromagnetic solenoid 50 is turned to ON (conducting), due to the electromagnetic force, the relief valve 47 acts against the force of the spring 49 and is pulled upward. It detaches from the seat 48 and opens the relief passage 45. The upper end of the relief valve 47 is shaped like a disc and is the part that receives the spring 49. The bottom is spherical and is the part where the seat 48 is mounted.

The electromagnetic solenoid 50 is located above the stopper member 41, separated at a prescribed distance; and between the electromagnetic solenoid 50 and the stopper member 41 a relief chamber 52 is formed to retain for a time the fuel that flows out of the pressure control chamber 37 through the relief passage 45. The relief chamber 52 links to the fuel return passage 23, and the fuel in the relief chamber 52 is returned to a fuel tank 1 through the fuel return passage 23.

The approximate upper half of the needle valve 36 rubs against the inside surface 40 of the nozzle body 30, while the approximate lower half is smaller in diameter than the inside surface 40, so that a fuel puddle 31 forms between it and the nozzle body 30. The bottom (end) of the needle valve 36 and the nozzle body 30 fit together to form a conical shape, and the conical portion 58 of the bottom of the needle valve 36 mounts to and becomes detached from a seat 57 at the bottom of the nozzle body 30, opening and closing a spray hole 59.

Figure 4:
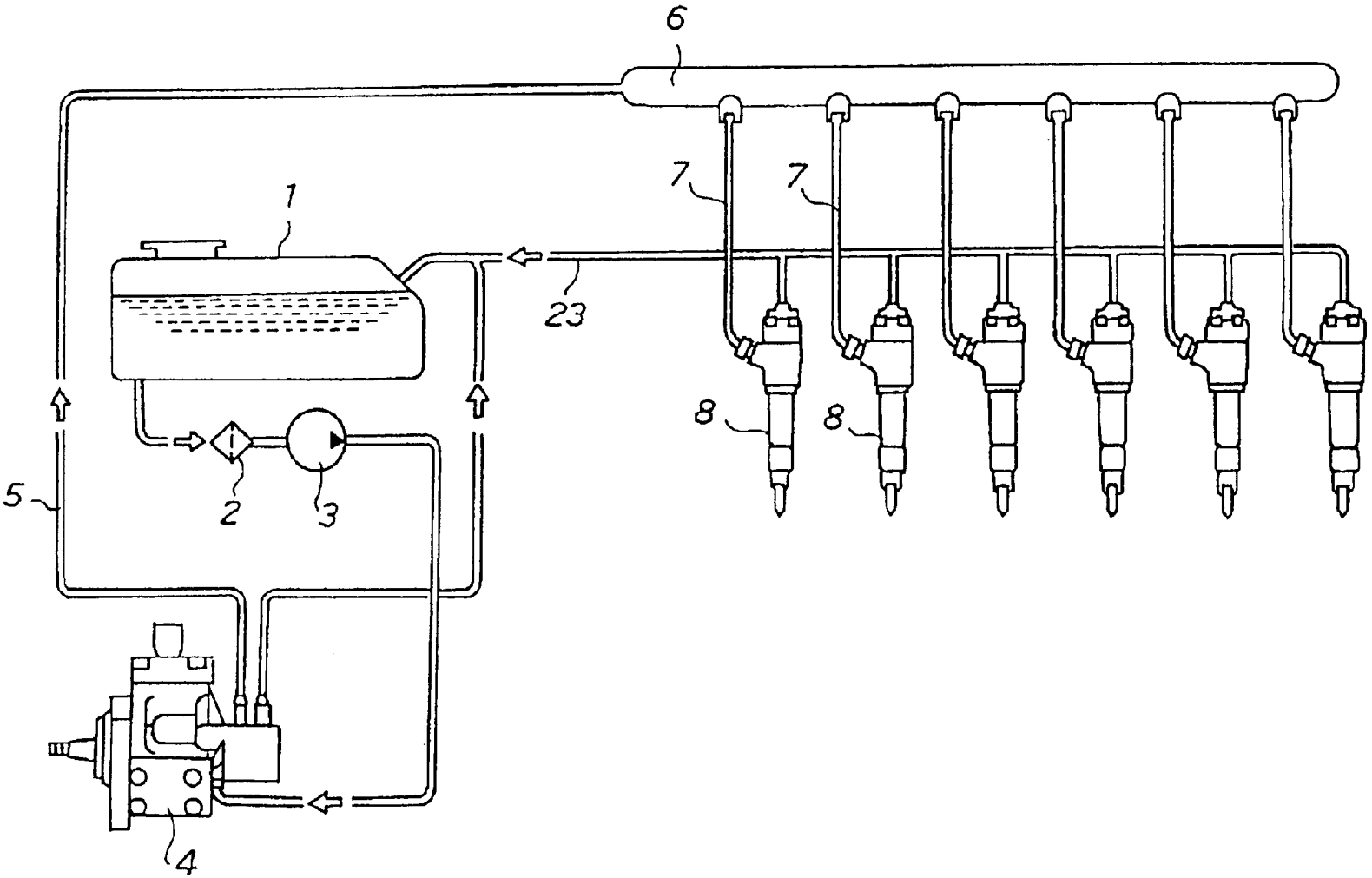
FIG. 4 is a compositional view showing a common rail-type fuel injection device.
Figure 5:
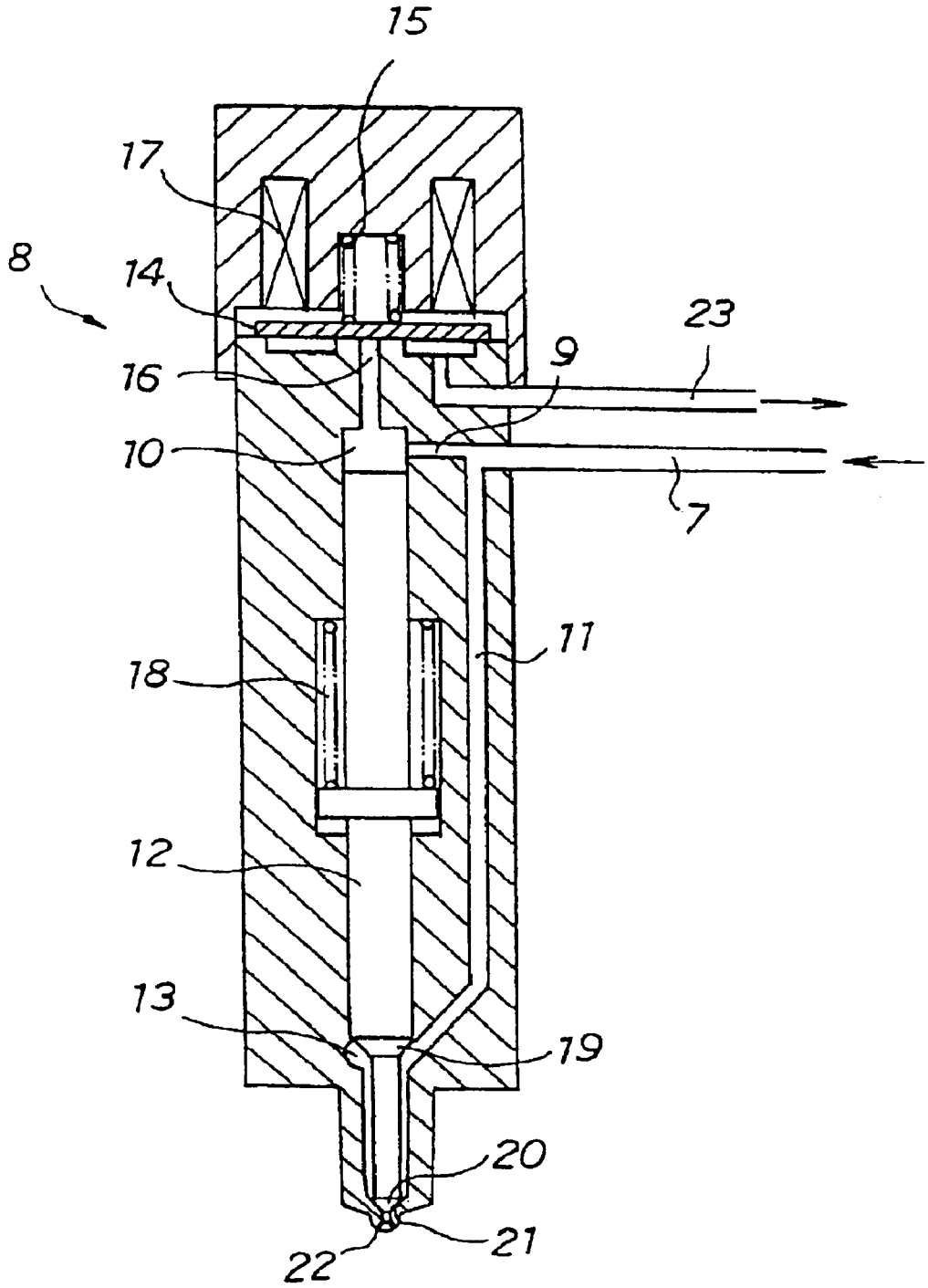
FIG. 5 is a longitudinal sectional view showing a conventional injector for fuel injection.

The fuel supply passage 7 branches out in the middle, and one branch passage 7*a* communicates with the relief passage 45 while the other branch passage 7*b* communicates with the fuel puddle 31. Therefore, the high-pressure fuel (tens to hundreds of MPa) in the common rail 6 as shown in FIG. 4, is constantly supplied to the relief passage 45 through the fuel supply passage 7 and the one branch passage 7*a,* and is constantly supplied to the fuel puddle 31 through the fuel supply passage 7 and the other branch passage 7*b*.

Particularly, in this injector 8*b,* a damper device to perform damping on the upward movement (lift) of the needle valve 36 is formed. This damper device mainly comprises a damper member 62 slidably mounted to the needle valve 36; a damping chamber 63 that becomes filled with fuel, formed between the damper member 62 and the needle valve 36; a leak passage 64 for extracting fuel from inside the damping chamber 63 and leaking it outside the chamber; and a stopper member 41 positioned above the damper member 62 for restricting the lift position of the damper member 62.

The damper member 62 is a hollow cylindrical shape and is slidably inserted from above in an axial direction into a hole 66 of the cross-sectional circle formed in the needle valve 36, on the same axis. It is positioned inside the pressure control chamber 37 and is able to move up and down therein. The hole 66 is formed in the central portion of the needle valve 36 and is formed to a prescribed depth in an axial direction from the upper surface 38 of the needle valve 36. It has a fixed inside diameter along its whole depth. The damper member 62 combines a flange 67 at its upper end and a cylinder 68 extending from below the flange 67. The cylinder 68 has about the same diameter as the hole 66 and is slidably inserted into the hole 66. However, the circumference at the upper end of the cylinder 68 is narrowed so that its diameter is smaller and a small gap 69 is formed between it and the inner surface of the hole 66. The flange 67 is bigger in diameter than the hole 66 and is smaller in diameter than the upper surface 38 of the needle valve and the inside surface 40 of the nozzle body, and is positioned so as to protrude above the hole 66 and the upper surface 38 of the needle valve, while also being positioned in the pressure control chamber 37.

In this way, a damping chamber 63 is formed between the damper member 62 and the hole 66 of the needle valve 36. In the damping chamber 63, a biasing means is formed to impel the damper member 62 upward. The biasing means here consists of a coil spring 70 which is inserted in a compressed state into a spring insertion hole 71 consisting of the central hole of the cylinder 68, and is supported by the circumference, preventing bending and the like. The spring insertion hole 71 is formed from the bottom of the cylinder 68 upward to a prescribed depth, in this case so as to reach the flange 67.

The leak passage 64 is positioned in the center of the flange 67 on the same axis as the relief passage 45, and is formed to pass through the flange 67 in an axial direction. The inside diameter is sufficiently small to be able to block the flow of fuel from the damping chamber 63, and is sufficiently small in comparison to the inside diameter of the relief passage 45.

As shown in FIG. 1, when the damper member 62 lifts upward the flange 67 abuts against the stopper member 41 and the lift position is restricted. At this time the entire upper surface of the flange 67 has surface contact with and mounts to the lower surface 42 of the stopper member 41 and in fact closes the relief passage 45. Accordingly, the relief passage 45 no longer communicates with the pressure control chamber 37, but instead communicates with the damping chamber 63 through the leak passage 64.

Figure 3:
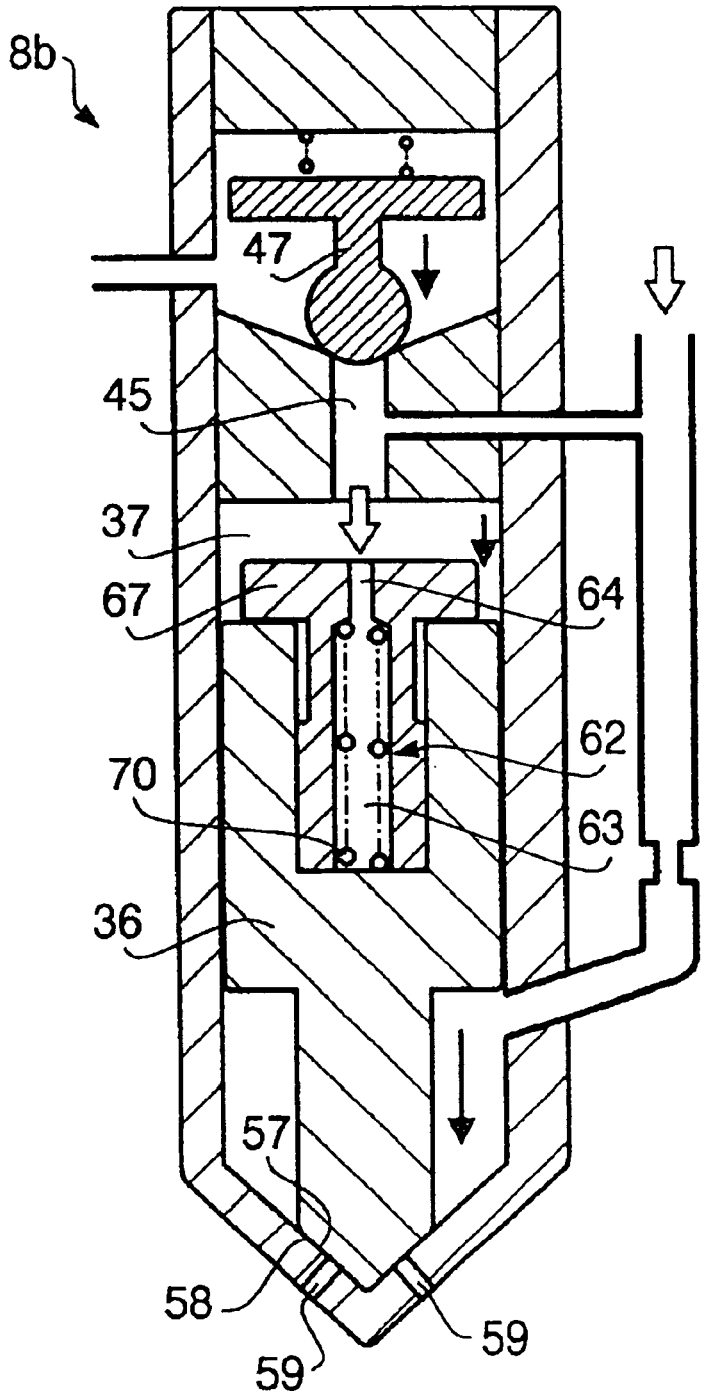
FIG. 3 is a longitudinal sectional view showing an injector according to a preferred embodiment of the present invention and showing the fuel_injection completion mode.

Conversely, as shown in FIG. 3, when the damper member 62 is moving downward and the flange 67 becomes detached from the stopper member 41, the relief passage 45 communicates with the pressure control chamber 37 and also communicates with the damping chamber 63 through the leak passage 64.

Next the application of this embodiment will be explained.

FIG. 1 shows the state when the electromagnetic solenoid 50 is OFF, in other words, after the relief valve 47 has closed and a prescribed period of time has elapsed. At this time, since the relief valve 47 has closed the relief passage 45, the relief passage 45, the pressure control chamber 37, the leak passage 64 and the damping chamber 63 have an equal fuel pressure to that sent from the common rail 6. Accordingly, the downward force on the needle valve 36 created by this fuel pressure and the spring 55 becomes greater than the upward force thereon created by the fuel pressure in the fuel puddle 31, and the needle valve 36 is pressed downward. Accordingly the conical portion 58 of the needle valve 36 is mounted to the seat 57 and the spray hole 59 is closed, halting fuel injection.

As described above, at this time the damper member 62 is pressed onto the lower surface 42 of the stopper member 41 by the coil spring 70, and the relief passage 45 communicates only with the damping chamber, through the leak passage 64.

Figure 2:
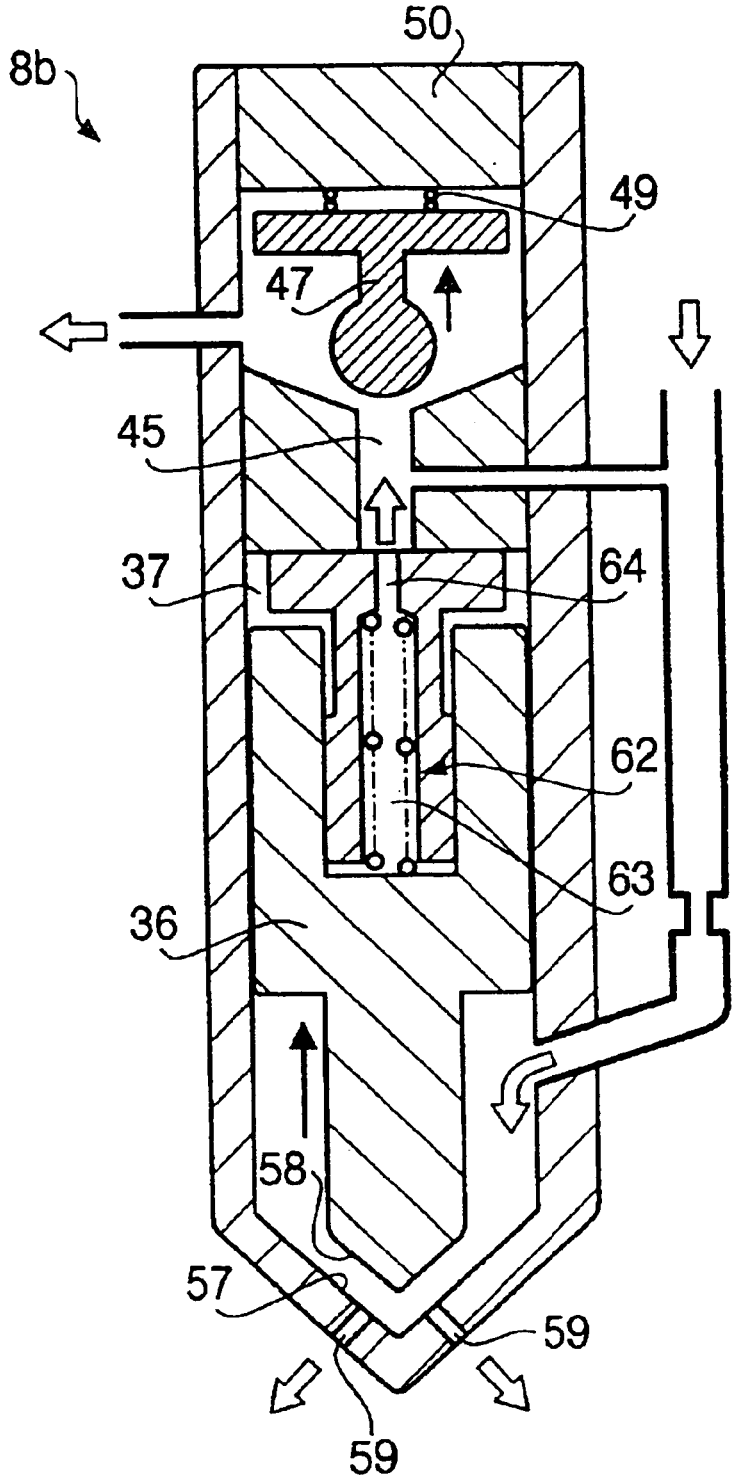
FIG. 2 is a longitudinal sectional view showing an injector according to a preferred embodiment of the present invention and showing the fuel injection mode.

From this state, when the electromagnetic solenoid 50 is ON, in other words when the relief valve 47 is opened, as shown in FIG. 2, the relief valve 47 is pulled upward and the relief passage 45 is opened, thereby discharging (leaking) fuel in the damping chamber 63 through the leak passage 64 and relief passage 45. When this happens the fuel pressure in the damping chamber 63 decreases, lessening the downward force on the needle valve 36 accordingly. Consequently, the upward force on the needle valve 36 becomes greater than the downward force thereon, and the needle valve 36 lifts upward. Accordingly the conical portion 58 becomes detached from the seat 57 and the high-pressure fuel stored in the fuel puddle 31 is injected from the spray hole 59.

In particular, when the needle valve 36 lifts, the fuel in the damping chamber 63 is discharged while being extracted in the leak passage 64. Therefore the high pressure in the damping chamber 63 is easier to maintain and this high pressure resists the needle valve 36 that is attempting to lift. In other words, the needle valve 36 receives resistance as it lifts. Consequently, the needle valve 36 lifts comparatively smoothly and at slow speed. Due to this, damping of the lift of the needle valve 36 is achieved and the initial injection rate is decreased.

From this state, when the electromagnetic solenoid 50 is OFF, in other words when the relief valve 47 is closed, first the fuel pressure supplied to the relief passage 45 acts directly in a downward direction on the upper surface of the flange 67 of the damper member 62. When this happens the damper member 62 moves downward slightly and detaches from the stopper member 41. At this instant the high-pressure fuel flows all at once from the gap into the pressure control chamber 37. Accordingly, the damper member 62 and the needle valve 36 are pressed downward together by this high-pressure fuel. Meanwhile, the pressure has decreased at the tip of the needle valve 36 since the fuel has flowed from the spray hole 59. Consequently, the downward force on the needle valve 36 suddenly becomes greater than the upward force thereon, and as shown in FIG. 3, the needle valve 36 moves downward comparatively rapidly, and the conical portion 58 is mounted to the seat 57 making fuel injection halt comparatively rapidly. In this way, the injection cut-off at the completion of injection is improved. FIG. 3 shows the state immediately after the conical portion 58 has mounted and injection has ended.

After this, during the initial period, the pressure in the damping chamber 63 is lower than the pressure in the pressure control chamber 37. However, since the fuel in the pressure control chamber 37 is gradually supplied into the damping chamber 63 through the leak passage 64 and a gap in the fitting in the damper member insertion part (to be described later), the pressure in the damping chamber 63 increases and the damper member 62 lifts upward relative to the needle valve 36 because of this pressure and the coil spring 70. Finally there is a return to the state shown in FIG. 1. In other words, once the relief valve 47 is closed and a fixed period of time has elapsed, the injection stand-by mode in FIG. 1 is reached and for each injection the cycle of FIG. 1_FIG. 2_FIG. 3_FIG. 1 is repeated.

In this embodiment, since the damper member 62 is slidably mounted to the needle valve 36, the needle valve 36 functions as a guide for the damper member 62, and the upward and downward movement of the damper member 62 is stabilized. Particularly at the time of fuel injection as shown in FIG. 2, the damper member 62 does not vibrate. Accordingly, the fuel leakage can be stably produced and the needle valve 36 can be lifted at a consistently stable speed. Thus the initial injection rate for each injection can be stabilized. Further, since the damper member 62 has a flange 67 and this flange 67 mounts to the stopper member 41 with a comparatively wide area, this can also prevent vibration of the damper member 62 and assists stabilization of injection.

In this case, a gap in the fitting is formed in the insertion part between the damper member 62 and the hole 66. Accordingly, at the time of fuel injection, as shown in FIG. 2, the fuel in the pressure control chamber 37 flows through this gap into the damping chamber 63. Of course, the passage area of this gap is smaller than the area of the leak passage 64, so the leak speed of the fuel and the lift speed of the needle valve 36 are restricted solely by the passage area of the leak passage 64. Note that at this time the high-pressure fuel supplied to the relief passage 45 continues to flow upward and is discharged.

Further, at the time of fuel injection, despite the lift speed of the needle valve 36 being restrained from start to finish, if the passage area between the conical portion 58 and the seat 57 is greater than the total area of the spray hole 59, injection can be carried out as usual. Since the total area of the spray hole 59 is exceptionally small, this enables a shift to ordinary injection after a minimal amount of time following the start of injection. In such a way, the present device is only designed to substantially restrict the initial injection rate and does not affect fuel injection thereafter.

Figure 6:
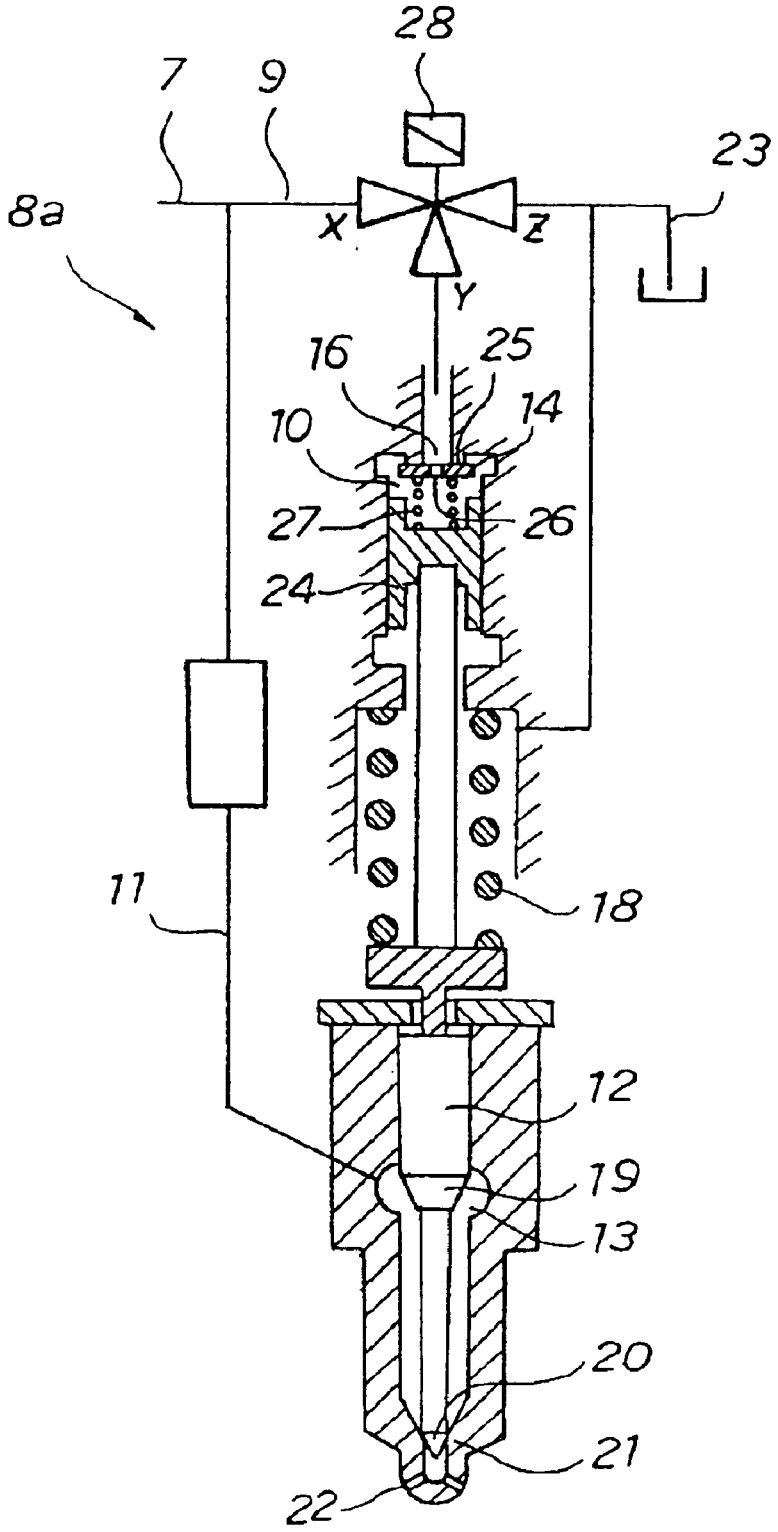
FIG. 6 is a longitudinal sectional view showing a conventional injector for fuel injection equipped with a needle lift damper device.

At the same time, the present embodiment is not of the same type as the conventional technology (FIG. 6), in which a pressure control chamber 10 functions also as a damping chamber, but consists instead of the damping chamber 63 that is separate from the pressure control chamber 37. Consequently, the increase and decrease of the pressure in the pressure control chamber 37 and the damping chamber 63 can be produced independently and stably, with the result that damping does not become erratic due to pressure variation in the pressure control chamber 37, and a stable damping effect can consistently be obtained.

Note that the embodiments of the present invention are not limited to what has been described above. For example the shape and other properties of the needle valve and damping member may be changed. As regards the driving means to open and close the relief valve, instead of the mechanism using electromagnetic force and the force of a spring described above, a mechanism for positive driving using fuel pressure, hydraulic pressure or air pressure for example may also be considered. Similarly, it is possible to use something other than a coil spring for the biasing means to impel the damper member. Further, the present invention can be applied to a broad range of fuel injection devices, for example, it can also be applied to an injector in a gasoline engine.

The present invention can be applied to a fuel injection device in an engine, particularly a common rail-type fuel injection device in a diesel engine.

What is claimed is:

1. A needle lift damper device in an injector for fuel injection, which is a damper device provided, to produce damping of the lift of a needle valve, in an injector that lifts said needle valve that is pressed downward under a fuel pressure inside a pressure control chamber, by relieving said fuel pressure, comprising:

a damper member slidably mounted to said needle valve;

a damping chamber that is formed between said damper member and said needle valve, and becomes filled with fuel;

a leak passage for extracting fuel from inside said damping chamber and leaking it outside said chamber; and a stopper member located above said damper member for restricting the lift position of said damper member;

wherein said damper member is inserted into a hole formed in said needle valve such that the damper member is slidable in an axial direction.

2. The needle lift damper device in an injector for fuel injection according to claim 1, wherein said stopper member is positioned above said needle valve, said pressure control chamber is defined therebetween, while said hole is formed axially to have a prescribed depth from the upper surface of said needle valve, said damper member is inserted into said hole from above and is able to move up and down in said pressure control chamber, said damping chamber is formed between said damper member and said hole, and said leak passage is formed so as to pass through said damper member in an axial direction.

3. The needle lift damper device in an injector for fuel injection according to claim 2, wherein the upper end of said damper member is a flange that is larger in diameter than said hole and smaller in diameter than the upper surface of said needle valve, and said flange is positioned above said hole and said upper surface of said needle valve and inside said pressure control chamber.

4. The needle lift damper device in an injector for fuel injection according to any one of claim 1, wherein a biasing means to impel said damper member upward is formed in said damping chamber.

5. The needle lift damper device in an injector for fuel injection according to claim 4, wherein said biasing means consists of a coil spring, a spring insertion hole having a prescribed depth is formed in said damper member so as to extend upward from the lower end thereof, and said coil spring is inserted into said spring insertion hole.

6. The needle lift damper device in an injector for fuel injection according to any one of claim 1, wherein said stopper member is provided with a relief passage, opening into said pressure control chamber to relieve the fuel pressure therein.

7. The needle lift damper device in an injector for fuel injection according to claim 6, wherein, when said damper member abuts against said stopper member, said relief passage is prevented from communicating with said pressure control chamber and communicates with said damping chamber through said leak passage.

8. The needle lift damper device in an injector for fuel injection according to claim 6, wherein said fuel pressure is introduced into said pressure control chamber through said relief passage.

9. The needle lift damper device in an injector for fuel injection according to any one of claim 6, wherein above said stopper member, a relief valve to open and close the exit of said relief passage and an driving means to drive the opening and closing of said relief valve are formed.

10. The needle lift damper device in an injector for fuel injection according to claim 9, wherein said driving means consists of a spring and electromagnetic solenoid.

11. The needle lift damper device in an injector for fuel injection according to any one of claim 6, wherein when said relief valve is closed and a prescribed period of time has elapsed, said pressure control chamber and said damping chamber reach a high pressure equal to said fuel pressure and said needle valve is depressed, fuel injection is halted, and said damper member abuts against said stopper member;

from this state, when said relief valve opens, said high-pressure fuel in said damping chamber flows through said leak passage and is gradually leaked into said relief passage, enabling said needle valve to lift up comparatively smoothly and said initial injection is carried out comparatively smoothly;

from this state, when said relief valve is closed, said fuel pressure supplied to said relief passage acts on said damper member and said damper member and said needle valve are depressed together, making said needle valve move downward comparatively rapidly and fuel injection is halted comparatively rapidly.

12. The needle lift damper device in an injector for fuel injection according to any one of claim 1, wherein when applied to a common rail-type fuel injection device in a diesel engine, said fuel pressure is supplied from said common rail.

13. A needle lift damping method in an injector for fuel injection, which is a damping method for damping the lift of a needle valve in an injector that lifts said needle valve that is depressed under a fuel pressure inside a pressure control chamber, by relieving said fuel pressure, comprising the steps of:

slidably mounting a damper member to said needle valve;

forming a damping chamber that becomes filled with fuel, between said damper member and said needle valve;

providing a leak passage for extracting fuel inside the damping chamber and leaking it outside the chamber;

providing a stopper member positioned above said damper member that restricts the lift position thereof; and damping the lift of said needle valve by extra and leaking the fuel in said damping chamber through said leak passage when said needle valve is lifted;

wherein said damper member is inserted into a hole formed in said needle valve so as to be slidable in an axial direction.

14. The needle lift damping method in an injector for fuel injection according to claim 13, wherein said stopper member is positioned above said needle valve and said pressure control chamber is defined therebetween, while said hole is formed to a prescribed depth axially from the upper surface of said needle valve; said damper member is inserted into said hole from above and is able to move up and down in said pressure control chamber; said damping chamber is formed between said damper member and said hole; said leak passage is formed so as to pass through said damper member in an axial direction; and said damper member is impelled upward by a biasing means formed in said damping chamber.

15. The needle lift damping method in an injector for fuel injection according to any one of claim 13, wherein a relief passage, opening into said pressure control chamber is formed so as to pass through said stopper member in an axial direction, and the fuel pressure in said pressure control chamber is relieved by said relief passage.

16. The needle lift damping method in an injector for fuel injection according to claim 15, wherein said relief passage and said leak passage are positioned on the same axis and when said damper member abuts against said stopper member, said relief passage is prevented from communicating with said pressure control chamber and communicates with said damping chamber through said leak passage, and before said needle valve begins to lift, said damper member is made abut against said stopper member.

17. The needle lift damping method in an injector for fuel injection according to claim 15, wherein, when said relief valve is closed and a prescribed period of time has elapsed, said pressure control chamber and said damping chamber reach a high pressure equal to the fuel pressure and said needle valve is depressed, fuel injection is halted and said damper member abuts against said stopper member;

when said relief valve opens, from this state, said high-pressure fuel in said damping chamber flows through said leak passage and is gradually leaked into said relief passage, enabling said needle valve to lift up comparatively smoothly and said initial injection is carried out comparatively smoothly; and when said relief valve is closed, from this state, said fuel pressure supplied to said relief passage acts on said damper member and said damper member and said needle valve are depressed together, making said needle valve move downward comparatively rapidly and fuel injection is halted comparatively rapidly.

18. The needle lift damping method in an injector for fuel injection according to any one of claim 13, wherein when applied to a common rail-type fuel injection device in a diesel engine, said fuel pressure can be supplied from said common rail.

* * * * *